United States Patent [19]

Puri

[11] Patent Number: 4,614,234

[45] Date of Patent: Sep. 30, 1986

[54] METHOD OF RECOVERING COAL VALUES BY COMBINING UNDERGROUND COAL GASIFICATION WITH SURFACE COAL LIQUEFACTION

[75] Inventor: Rajen Puri, Tulsa, Okla.

[73] Assignee: Standard Oil Company, Chicago, Ill.

[21] Appl. No.: 711,905

[22] Filed: Mar. 14, 1985

[51] Int. Cl.[4] ..... E21B 43/243

[52] U.S. Cl. ..... 166/261; 166/266; 166/267; 208/428; 252/373; 585/943

[58] Field of Search ..... 166/256, 257, 258, 259, 166/261, 266, 267, 302; 208/8 R

[56] References Cited

U.S. PATENT DOCUMENTS

| | | | |
|---|---|---|---|
| 2,637,683 | 5/1953 | Kassel | 208/8 R |
| 2,969,226 | 1/1961 | Huntington | 166/261 X |
| 3,715,301 | 2/1973 | Tassoney | 208/8 R |
| 3,770,398 | 11/1973 | Abraham et al. | 166/256 X |
| 4,114,688 | 9/1978 | Terry | 166/258 X |
| 4,149,597 | 4/1979 | Redford | 166/266 X |
| 4,264,431 | 4/1981 | Ishikawa et al. | 166/266 X |
| 4,274,941 | 6/1981 | Janssen et al. | 208/8 R |
| 4,353,418 | 10/1982 | Hoekstra et al. | 166/261 X |
| 4,379,591 | 4/1983 | Tassoney | 299/2 |
| 4,469,584 | 9/1984 | Rhodes et al. | 208/8 R X |

*Primary Examiner*—George A. Suchfield
*Attorney, Agent, or Firm*—Robert R. Cochran

[57] ABSTRACT

Hot gases from an underground coal gasification operation are used to pyrolyze mined coal, which is subsequently used for surface steam generation, the steam being utilized in the underground coal gasification operation. Valuable gases and hydrocarbon liquids are obtained from the process.

4 Claims, 1 Drawing Figure

METHOD OF RECOVERING COAL VALUES BY COMBINING UNDERGROUND COAL GASIFICATION WITH SURFACE COAL LIQUEFACTION

BACKGROUND OF THE INVENTION

1. Field of the Invention

The present invention relates to surface liquefaction of mined coal by means of hot gases generated via underground gasification of carbonaceous material. Following liquefaction, the resulting char is burned in boilers to generate steam for use in the underground coal gasification plant.

2. Setting of the Invention

There are two well-known methods for mining coal. First, coal deposits at or near the surface are mined by strip mining which involves removing the overburden and thereafter removing the coal. Strip mining may cause serious environmental degradation of the surface and undersurface aquifers. Further, strong acidic components can leech the material exposed after the overburden is removed. Ecological restoration of land is expensive and may not be fully successful. Strip mining has had strict ecological and environmental controls placed upon it.

Secondly, where coal deposits are at considerable depths, 500 ft or greater, conventional shaft mining techniques must be resorted to. Mining of coal deposits too deep to be stripped of overburden involves large amounts of labor. Shaft coal mining is accomplished by a high incidence of accidents caused by mine collapses and explosions. Furthermore, deep mining of coal is inefficient in that only half the coal is extracted and that most of it is not mined at all because the seams are either too thin or too deep to permit economic working.

The present invention reduces the amount of mining required by combining a mining operation with underground coal gasification.

Underground gasification has proved to be useful to obtain energy from coal deposits. Coal gasification involves a high temperature reaction of carbonaceous material and water to produce primarily hydrogen, carbon monoxide and carbon dioxide. The required heat for the reaction can be provided by partial combustion of the coal and/or gasification products. The combustion method utilized can be forward combustion. Coal gasification methods require the drilling of a production well and an adjacent injection well through which oxygen and steam are injected into the coal seam. A flame or combustion front is initiated adjacent the wellbore face of the injection well and is advanced through the coal seam. The combustion front provides the heat energy necessary to gasify the coal. The combustion and gasification products (henceforth referred to as synthesis gas) are thereafter removed through the production well for use at the surface.

An object of the present invention is to provide a process for utilizing underground coal gasification to recover coal values and the use of the heat available in the produced synthesis gas to pyrolyze mined coal thereby recovering values therefrom. The resulting char from the pyrolysis step is available for steam generation in boilers.

Other objects and advantages of the present invention will be apparent to one skilled in the art upon reading this disclosure.

SUMMARY OF THE INVENTION

Broadly, my invention resides in a process for obtaining values from coal comprising establishing an underground combustion zone in a coal seam provided with at least one injection well and at least one production well, injecting oxygen and steam through said injection well to maintain a gasification zone in said coal seam thereby producing synthesis gas, removing synthesis gas to the surface from said combustion/gasification zone, directly heat exchanging said synthesis gas with mined coal in a pyrolysis zone thereby removing pyrolysis gases and liquids from said mined coal leaving char, burning said char to produce heat, using said heat to generate steam, and utilizing at least a portion of said steam for injection into said coal zone.

Further steps can include the separating of the liquid and gaseous products from said pyrolysis zone into separate product streams. The gasification products comprise hydrogen, carbon monoxide, carbon dioxide, and water. The pyrolysis products include coal liquids (primarily pentane soluble "oil"), hydrogen, carbon monoxide, carbon dioxide, methane, ethane, propane and butane.

BRIEF DESCRIPTION OF THE DRAWING

The drawing shows a schematic representation of the combination processes of coal gasification and pyrolysis forming the subject of the present invention.

DETAILED DESCRIPTION OF THE PREFERRED EMBODIMENT

Figure 1:
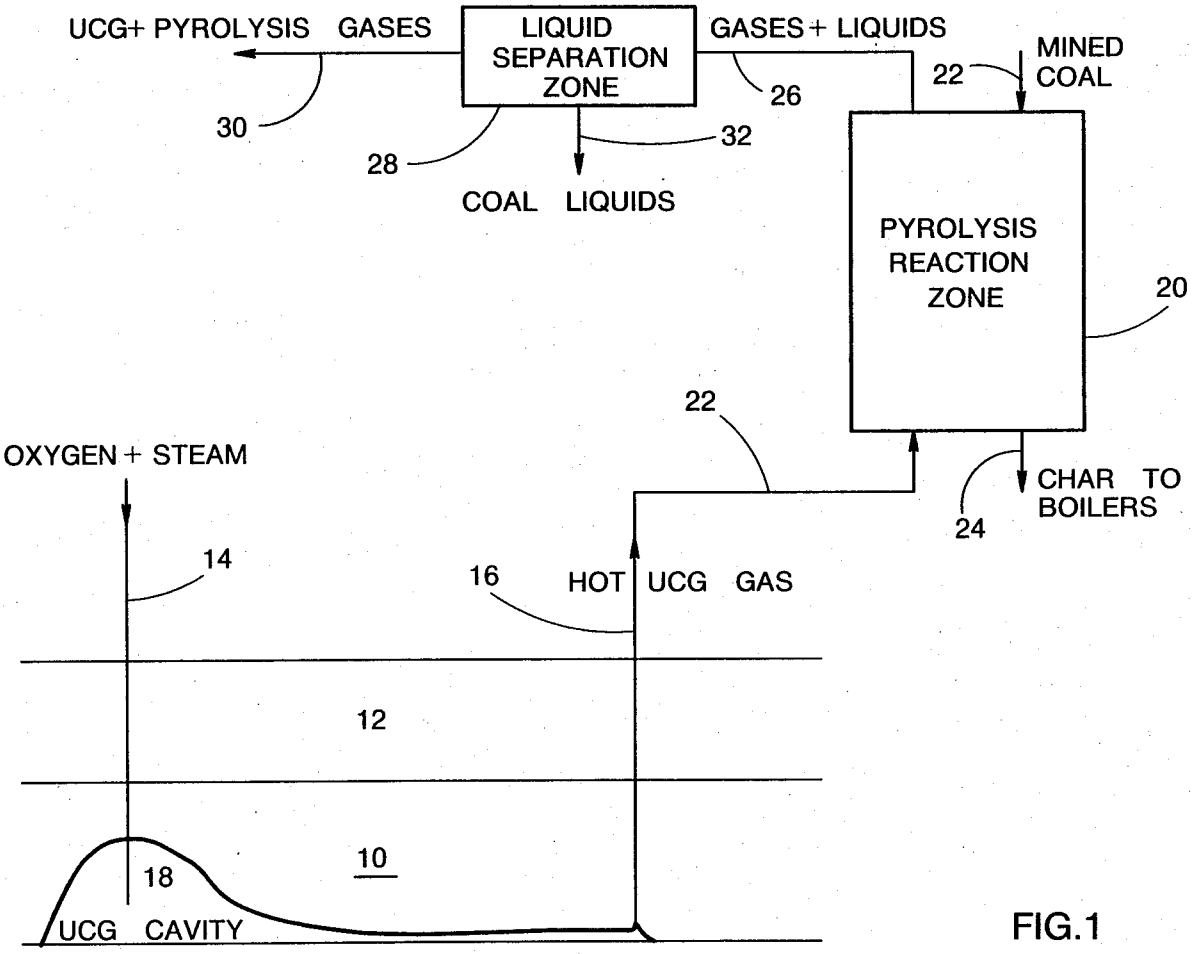

The steps of the invention can best be understood by considering the accompanying drawing.

Shown therein is a coal seam 10 underneath an overburden layer 12. By conventional methods, injection well 14 and production well 16 are drilled into the coal seam. Communication is established between wells 14 and 16 and the coal in zone 10 is ignited producing an underground coal gasification cavity 18. The hot underground coal gasification product gas, or synthesis gas, is produced through well 16. This gas includes water, carbon dioxide, carbon monoxide, and hydrogen. Above ground is provided a pyrolysis reactor 20. Conduit 22 supplies the hot synthesis gas to the pyrolysis reaction zone wherein it directly contacts mined coal supplied by conduit 22. Products from the pyrolysis reaction zone 20 include the char recovered through conduit 24 and liquid products obtained overhead as vapor, and removed in conduit 26. Conduit 26 extends to a liquid separation zone 28 producing a gas stream containing the underground coal gasification gaseous products and the pyrolysis gaseous products in conduit 30 and coal liquids in conduit 32. The conduit 26 will contain a product which comprises oil, hydrogen, carbon monoxide, carbon dioxide, methane, ethane, propane, and butane.

The following examples illustrate specific embodiments of my invention given for the purpose of illustration and they should not be considered unduly limiting.

EXAMPLE 1

This work is based upon an installation using a subbituminous coal obtained from the Co-op mine in Utah. The total amount of steam needed for this installation is 3.3 MM #/hr of 1465 psi, 900° F. steam, and 2.7 MM #/hr of 1465 psi saturated steam. This supplies all utilities as well as the oxygen plant. This coal produces, on a weight basis, when pyrolyzed at a temperature of 700°

F. and a pressure of 200 psig, 5.5% oil, 6.5% gas, 13.0% water and 75% char. This coal is used for the underground combustion zone and another portion obtained by mining. In this case, 26,000 tons/day of coal is gasified in situ producing a mixture of hydrogen, carbon dioxide, water and carbon monoxide. Oxygen injection amounts to 15,000 tons/day with steam injection at a rate of 8200 tons/day and a temperature of 550° F. at 325 psig. The energy required to generate the steam is 194 billion BTU/day requiring a feed to the boilers of char of 7,385 tons/day, the char having a heat value of 13,107 BTU/lb. The total raw synthesis gas produced is 41,000 tons/day. The mined coal supplied to the pyrolysis zone is 9,847 tons/day, this providing oil production of 4,975 bbl/day and pyrolysis gas production of 15.6 MMSCFD having a heating value of approximately 400 BTU/SCF. Water produced is 7,188 bbl/day. The temperature of the produced underground coal gasification synthesis gas is about 880° F. (470° C.) when it is recovered at the surface. This gas contains sufficient heat to raise the temperature of the surface mined coal from ambient (approximately 50° F.) to 700° F. The heat capacity of the mined coal is 0.24 BTU/lb ° F. and the heat capacity of the underground coal combustion gas is 0.21 BTU/lb ° F.

EXAMPLE 2

Coal was obtained from the Wyodak coal source in Wyoming which was pyrolyzed with hot synthesis gas. This permitted recovery of light hydrocarbons (oil) and combustible gases containing hydrogen, carbon monoxide, methane, ethane, butane, together with carbon dioxide. Utilizing the process described in this application, there would be obtained approximately 9 wt % of the dry coal as oil and 21 wt % of the dry coal weight as gas. This gas would have an average heating value of around 400 BTU/SCF.

While the present invention has been described with a certain degree of particularity, it is understood that the present disclosure is made by way of example and that changes in details may be made without departing from the spirit hereof.

I claim:

1. A process for obtaining values from coal comprising establishing an underground combustion zone in a coal seam provided with at least one injection well and at least one production well, injecting oxygen and steam through said injection well to maintain a combustion zone in said coal seam thereby producing synthesis gas, removing synthesis gas to the surface from said combustion zone, directly heat exchanging said synthesis gas with mined coal in a pyrolysis zone thereby removing pyrolysis gases and liquids from said mined coal leaving char, burning said char to produce heat, using said heat to generate steam, and utilizing at least a portion of said steam for injection into said coal seam.

2. The process of claim 1 including the step of separating the liquid and gaseous products from said pyrolysis zone into separator product steams.

3. The process of claim 1 wherein said synthesis gas comprises hydrogen, carbon monoxide, carbon dioxide and water.

4. The process of claim 1 wherein said pyrolysis gas and liquid output comprises oil, hydrogen, carbon monoxide, carbon dioxide, methane, ethane, propane and butane.

* * * * *